US010086234B2

(12) United States Patent
Petty et al.

(10) Patent No.: US 10,086,234 B2
(45) **Date of Patent: *Oct. 2, 2018**

(54) POLE CLIMBING FALL PREVENTION ASSEMBLY

(71) Applicant: D B Industries, LLC, Red Wing, MN (US)

(72) Inventors: Clifford D. Petty, Mooresville, IN (US); Judd J. Perner, Red Wing, MN (US); David A. Schlangen, Red Wing, MN (US)

(73) Assignee: D B INDUSTRIES, LLC, Maplewood, MN (US)

( * ) Notice: Subject to any disclaimer, the term of this patent is extended or adjusted under 35 U.S.C. 154(b) by 207 days.

This patent is subject to a terminal disclaimer.

(21) Appl. No.: 14/522,273

(22) Filed: Oct. 23, 2014

(65) Prior Publication Data

US 2015/0041250 A1 Feb. 12, 2015

Related U.S. Application Data

(63) Continuation of application No. 13/032,331, filed on Feb. 22, 2011, now Pat. No. 8,887,866.

(Continued)

(51) Int. Cl.
*A63B 27/00* (2006.01)
*A63B 27/02* (2006.01)

(52) U.S. Cl.
CPC ..... *A63B 27/02* (2013.01); *A63B 27/00* (2013.01); *Y10T 24/4002* (2015.01)

(58) Field of Classification Search
CPC ..... A62B 27/00
See application file for complete search history.

(56) References Cited

U.S. PATENT DOCUMENTS 869,382 A 10/1907 Newton
1,344,955 A 6/1920 Morse (Continued)

FOREIGN PATENT DOCUMENTS

CA 2676507 2/2010
CA 2681870 4/2010

(Continued)

OTHER PUBLICATIONS

International Search Report for Application PCT/US2012/065155 dated Jul. 22, 2013 5 pages.

(Continued)

*Primary Examiner* — Alvin C Chin-Shue

(57) ABSTRACT

A fall prevention assembly to prevent injuries when a user climbing a pole and falls, is provided. The fall prevention assembly includes a pole strap, a first connector, a floating back plate, a second connector and a lanyard. The pole strap has a first end, a second end and a mid portion between the first end and the second end. The first connector has a first end that is slidably coupled proximate the first end of the pole strap. The floating back plate is engaged between a portion of the first connector and the pole strap and is configured and arranged to selectively bind the pole strap to the first connector. The second connector is coupled a select distance from the second end of the pole strap. The lanyard has a first end, a second end and mid portion between the first and second ends. A second end of the first connector is slidably coupled to the lanyard. A second end of the second connector is slidably coupled to the lanyard such that the mid-portion of the pole strap and the mid-portion of the lanyard can be positioned around a pole to be climbed.

17 Claims, 18 Drawing Sheets

Related U.S. Application Data

(60) Provisional application No. 61/382,565, filed on Sep. 14, 2010, provisional application No. 61/311,318, filed on Mar. 6, 2010.

(56) References Cited

U.S. PATENT DOCUMENTS

| | | | | |
|---|---|---|---|---|
| 1,721,516 | A | 7/1929 | Jacobs | |
| 1,802,288 | A | 4/1931 | Strauss | |
| 2,053,600 | A * | 9/1936 | Camp | A44B 11/10 24/321 |
| 2,062,734 | A | 12/1936 | Troendly | |
| 2,105,516 | A | 1/1938 | Anderson | |
| 2,601,589 | A * | 6/1952 | Childers, Sr. | A62B 35/0068 182/9 |
| 2,920,714 | A | 1/1960 | Johnson | |
| 3,293,713 | A * | 12/1966 | Gaylord | A44B 11/10 24/196 |
| 3,407,451 | A * | 10/1968 | Dewey | B64D 17/32 24/196 |
| 3,407,898 | A | 10/1968 | Johnson | |
| 3,726,360 | A | 4/1973 | Price et al. | |
| 3,743,050 | A | 7/1973 | Danz | |
| 3,840,091 | A | 10/1974 | Conlon | |
| 4,407,391 | A | 10/1983 | Greenway et al. | |
| 4,527,660 | A | 7/1985 | Andruchiw | |
| 4,579,196 | A | 4/1986 | Allen et al. | |
| 4,595,078 | A | 6/1986 | Greenway | |
| 4,712,646 | A | 12/1987 | Page | |
| 4,747,468 | A | 5/1988 | Greenway | |
| 5,050,704 | A | 9/1991 | Olsson | |
| 5,137,113 | A | 8/1992 | Lortie | |
| 5,141,074 | A | 8/1992 | Sulowski et al. | |
| 5,184,696 | A | 2/1993 | Meed et al. | |
| 5,222,991 | A | 6/1993 | Bell | |
| 5,234,074 | A | 8/1993 | Bell | |
| 5,906,873 | A | 5/1999 | Kim | |
| 6,357,547 | B1 * | 3/2002 | Kellog | A62B 35/0075 182/9 |
| 6,581,726 | B1 | 6/2003 | Petzl et al. | |
| 6,644,438 | B1 | 11/2003 | Chang et al. | |
| 6,752,242 | B1 * | 6/2004 | Whitehead | A62B 35/0075 182/133 |
| 6,973,995 | B1 | 12/2005 | Diggle, III et al. | |
| 7,100,738 | B1 | 9/2006 | Diggle, III et al. | |
| 7,103,943 | B2 | 9/2006 | Lambert | |
| 7,571,520 | B2 * | 8/2009 | Shiue | A44B 11/20 24/265 BC |
| D610,434 | S | 2/2010 | Watts et al. | |
| 8,464,832 | B1 | 6/2013 | Rullo | |
| 8,887,866 | B2 | 11/2014 | Petty et al. | |
| 9,265,989 | B2 | 2/2016 | Perner | |
| 2004/0200666 | A1 | 10/2004 | Diggle, III et al. | |
| 2005/0247521 | A1 | 11/2005 | Diggle | |
| 2008/0148529 | A1 | 6/2008 | Huang | |
| 2010/0051382 | A1 | 3/2010 | Schlief | |
| 2010/0078261 | A1 * | 4/2010 | Watts | A62B 35/00 182/9 |
| 2010/0089694 | A1 * | 4/2010 | Paul | A63B 27/00 182/9 |
| 2011/0214941 | A1 | 9/2011 | Petty et al. | |
| 2011/0290586 | A1 | 12/2011 | Goldmann, II et al. | |
| 2012/0205193 | A1 | 8/2012 | Patel et al. | |
| 2012/0260865 | A1 * | 10/2012 | Nesper | A01K 27/003 119/792 |
| 2012/0292129 | A1 | 11/2012 | Seman | |
| 2014/0069352 | A1 | 3/2014 | Fidrych | |

FOREIGN PATENT DOCUMENTS

| | | |
|---|---|---|
| CN | 1485109 | 3/2004 |
| CN | 2912314 | 6/2007 |
| CN | 2917360 | 7/2007 |
| CN | 101564578 | 10/2009 |
| CN | 101511217 | 4/2011 |
| CN | 202590203 | 12/2012 |
| GB | 265542 | 3/1927 |
| JP | 10-151214 | 6/1998 |
| JP | 10151214 | 6/1998 |
| JP | 2003-070925 | 3/2003 |
| JP | 20030070925 | 3/2003 |
| WO | 20080054041 | 5/2008 |
| WO | WO 2008/054041 A1 | 5/2008 |
| WO | 20110112517 | 9/2011 |
| WO | WO 2011/112517 A2 | 9/2011 |

OTHER PUBLICATIONS

Buckingham Manufacturing Co. Inc., Instructions/Warnings 483/484 Series—BuckSqueeze (Patented), 483.DOC (Rev. Jun. 22, 2010), Part #230095, 11 pages.

Buckingham Manufacturing Co. Inc., 483 D—BuckSqueeze for Distribution [online] [retrieved May 2, 2011] Retrieved from the Internet: http//www.buckinghammfg.com/index.cfm?fuseaction=product.display&product_ID=1167&CFID=2309333&CFTOKEN=79970743>, 3 pages.

Buckingham Manufacturing Co. Inc., 9-8 BuckAdjuster [online] [retrieved May 2, 2011] Retrieved from the Internet: <http://www.buckinghammfg.com/index.cfm?fuseaction=product.display&product_ID=2361&ParentCat=72>, 1 page.

Buckingham Manufacturing Co. Inc., Woven Nylon Positioning Strap with Friction Buckle [online] [retrieved May 2, 2011] Retrieved from the internet: <http://www.buckinghammfg.com/index.cfm?fuseaction=category.display&category_ID=334>, 2 pages.

Huntsville Choker image, Fall Protection in Ontario, Fall Restrict Devices for Wood Pole Climbing. Date unknown, 3 pages.

J.E. Lortie Jelco, Pole Choker Standard Features, The Pole Choker Specifications for Pole Choker 3, Pole Choker 4, Pole Choker 5, Pole Choker 6 [online ] Date unknown, Retrieved online: sales@ielco-alubox.com>, 2 pages.

Jelco Co. Ltd., Pole Choker™ 5 [online] [retrieved May 2, 2011] Retrieved from the internet: <http://www.jelco.ca/en/index.php>, 2 pages.

Klein Tools-Pole Master™, Lineman's Climbing Equipment & Harnesses, FPD-5295, [online], [retrieved May 2, 2011] Retrieved from the Internet:http: /www.service.kleintools.com/cgibin/lansaweb?procfun+KD01+KD01025+PRD+ENG+FUNCPARMS+KD01YYCTN(P0020):2+KD01 YYPRD(A0150):FPD-5295>, 1 page.

Petzl Lanyards and Energy Absorbers, Grillon Hook [online][retrieved May 2, 2011] Retrieved from the internet: <http://www. petzl.com/en/pro/lanyards-and -energy-absorbers>, 3 pages.

Scepter, SPS-2000 PoleShark [online] [retrieved May 2, 2011] Retrieved from the internet: <http://www.poleshark.com/products/sps 2000>, 2 pages.

Scepter, Instructions on how to properly use your PoleShark 3000 [online][retrieved May 2, 2011] Retrieved from the internet: <http//www.poleshark.com/instructions/>, 1 page.

Minseal, Mineral Seal Corporation, Ceramic Fiber Net, "CereTex Ceramic Fiber Cloth", 2008 [online], <http:/ /www.ceramicfiber.net/ceramifibercloth.htm> 1 page.

Notice of References (892) Office Action for U.S. Appl. No. 13/032,331, dated Oct. 10, 2013.

International Search Report for PCT/US2011/027413 dated Sep. 9, 2011.

International Partial Search Report from PCT Application No. PCT/US2011/027413, dated Jul. 14, 2011.

PCT International Search Report for Application PCT/US2012/065155 dated Jul. 22, 2013 5 pages.

RR for U.S. Appl. No. 13/675,556 dated Aug. 5, 2014 (5 Pages).

OA for U.S. Appl. No. 13/675,556 dated Jan. 30, 2015 (11 pages).

Final OA for U.S. Appl. No. 13/675,556 dated Aug. 7, 2015 (13 pages).

NOA for U.S. Appl. No. 13/675,556 dated Oct. 21, 2015 (7 Pages).

RR for U.S. Appl. No. 13/032,331 dated Jun. 14, 2013 (6 Pages).

OA for U.S. Appl. No. 13/032,331 dated Oct. 10, 2013 (6 Pages)

FOA for U.S. Appl. No. 13/032,331 dated May 8, 2014 (11 Pages).

NOA for U.S. Appl. No. 13/032,331 dated Jul. 18, 2014 (8 Pages).

(56) References Cited

OTHER PUBLICATIONS

International Search Report and Written Opinion for PCT/US2011/027413 dated Sep. 20, 2012.
Buckingham Manufacturing Company, Inc., 483 D—BuckSqueeze for Distribution [online] [retrieved May 2, 2011] Retrieved from the Internet: http://www.buckinghammfg.com/index.cfm?fuseaction=product.display&product_ID=1167&CFID=2309333&CFTOKEN=79970743>, 3 pages.
Buckingham Manufacturing Company, Inc. 9-8 BuckAdjuster [online] [retrieved May 2, 2011] Retrieved from the internet: <http://www.buckinghammfg.com/index.cfm?fuseaction=product.display&product_ID=2361&ParentCat=72>, 1 page.
Buckingham Manufacturing Company, Inc. Woven Nylon Positioning Strap with Friction Buckle [online] [retrieved May 2, 2011] Retrieved from the internet: <http://www.buckinghammfg.com/index.cfm?fuseaction=category.display&catagory_ID=334>, 2 pages.
J.E. Lortie Jelco, Pole Choker Standard Features, The Pole Choker Specifications for Pole Choker 3, Pole Choker 4, Pole Choker 5, Pole Choker 6 [online] Date unknown, Retrieved online: sales@jelco-alubox.com>, 2 pages.
Klein Tools-Pole Master™, Lineman's Climbing Equipment & Harnesses, FPD-5295, [online], [retrieved May 2, 2011] Retrieved from the Internet: http://www.service.kleintools.com/cgi-bin/lansaweb?procfun+KD01+KD01025+PRD+ENG+FUNCPARMS+KD01YYCTN(P0020):2+KD01YYPRD(A0150):FPD-5295>, 1 page.
Minseal Mineral Seal Corporation. Cera Tex Ceramic Fiber Cloth [online] 2008 [retrieved Sep. 26, 2013]. Retrieved from the internet: <http://www.ceramicfiber.net/ceramicfibercloth.htm>, 1 page.
Petzl Lanyards and Energy Absorbers, Grillon Hook [online] [retrieved May 2, 2011] Retrieved from the internet: <http://www.petzl.com/en/pro/lanyards-and-energy-absorbers>, 3 pages.
Scepter, SPS—2000 PoleShark [online] [retrieved May 2, 2011] Retrieved from the internet: <http://www.poleshark.com/products/sps_2000>, 2 pages.
Scepter, Instructions on how to properly use your PoleShark 3000 [online] [retrieved May 2, 2011] Retrieved from the internet: <http//www.poleshark.com/instructions/>, 1 page.
Restriction Requirement for U.S. Appl. No. 14/994,909 dated Feb. 14, 2017 (5 Pages).
Office Action for U.S. Appl. No. 14/994,909 dated May 2, 2017 (18 Pages).
Notice of Allowance with Interview Summary for U.S. Appl. No. 14/994,909 dated Aug. 18, 2017 (10 Pages).

* cited by examiner

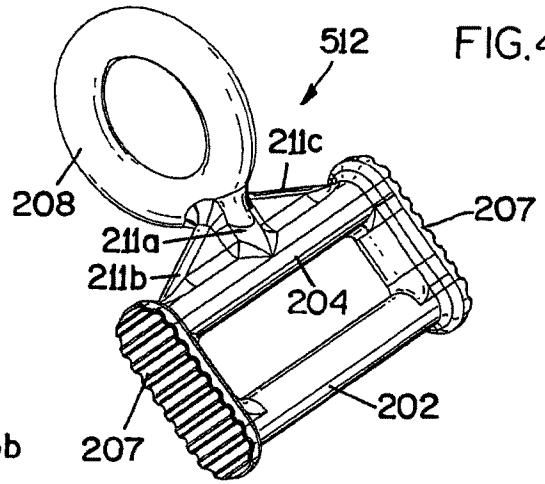
FIG.4B
FIG.4C
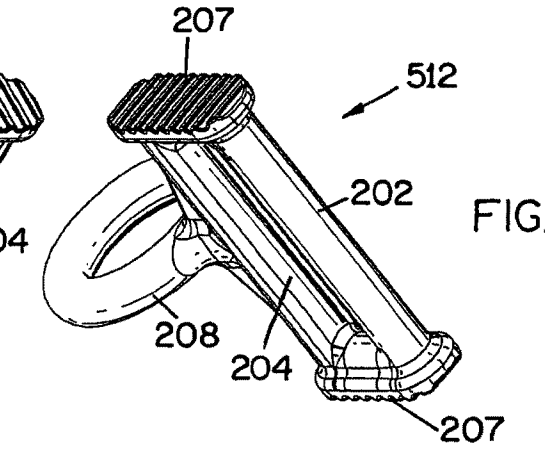
FIG.4D
FIG.4E

POLE CLIMBING FALL PREVENTION ASSEMBLY

CROSS-REFERENCE TO RELATED APPLICATIONS

This Application claims priority to U.S. Provisional Application Ser. No. 61/311,318, titled "Pole Grabber (Restricting Belt/Pole Climbing Fall Protection System) With Adjustable Pole Strap Dee Ring," filed on Mar. 6, 2010 and U.S. Provisional Application Ser. No. 61/382,565, titled "Pole Choker Assembly," filed on Sep. 14, 2010, and is a continuation of U.S. application Ser. No. 13/032,331 filed Feb. 22, 2011, titled "Pole Climbing Fall Prevention Assembly," now U.S. Pat. No. 8,887,866 issued Nov. 18, 2014, all of which are incorporated in their entirety herein by reference.

BACKGROUND

Fall protection equipment is commonly utilized to prevent injuries to workers who need to climb poles to install and repair equipment. Such fall protection equipment typically includes a safety harness donned by the worker and safety equipment, such as a pole choker assembly, connecting the safety harness and the pole. The safety equipment allows the worker to climb up and down the pole while preventing the worker from falling to the ground if a fall event occurs.

For the reasons stated above and for other reasons stated below which will become apparent to those skilled in the art upon reading and understanding the present specification, there is a need in the art for an efficient and effective fall prevention assembly.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a fall prevention assembly is provided. The fall prevention assembly includes a pole strap, a first connector, a floating back plate, a second connector, a lanyard and an engaging sleeve. The pole strap has a first end, a second end and a mid-portion between the first end and the second end. The first connector has a first end that is slidably coupled proximate the first end of the pole strap. The floating back plate is engaged between a portion of the first connector and the pole strap. The floating back plate is configured and arranged to selectively bind the pole strap to the first connector in a static position. The second connector is coupled proximate the second end of the pole strap. The lanyard has a first end, a second end and mid-portion between the first and second ends. A second end of the first connector is slidably coupled to the lanyard. A second end of the second connector is slidably coupled to the lanyard, such that the mid-portion of the pole strap and the mid-portion of the lanyard can be positioned around a pole to be climbed. In addition, the engaging sleeve is received around the mid-portion of the lanyard to engage the pole to be climbed.

In another embodiment, another fall prevention assembly is provided. This fall prevention assembly includes first and second elongated members, first and second connectors and a rope grab. The first elongated member has a first end, a second end and mid portion between the first and second ends. The first elongated member is configured to be positioned around an outside portion of a pole to be climbed in relation to a user of the fall prevention assembly. The second elongated member has a first end, a second end and a mid portion between the first and second ends. The second elongated member is configured to be positioned around an inside portion of the pole to be climbed in relation to the user of the fall prevention assembly. The second end of the second elongated member is configured and arranged to be selectively coupled to a safety harness of the user. The first connector has a first portion that is selectively sideably coupled to the first elongated member and a second portion that is sideably coupled to the second elongated member. The second connector has a first portion coupled a select distance from the second end of the first elongated member and a second portion coupled to the second elongated member such that the first and second connectors couple the first and second elongated members around the pole. The rope grab is engaged with the second elongated member. The rope grab is configured and arranged to be selectively coupled to the safety harness of the user.

In still another embodiment, an adjustment assembly is provided. The adjustment assembly includes a sliding adjustment member and a floating back plate. The sliding adjustment member includes a first post, a second post, a first side plate, a second side plate and a connecting head. The first post and the second post extend between the first plate and the second plate in a spaced fashion such that the passage is formed by the first post, the second post, the first side plate and the second side plate. The connecting head extends from the second post. The floating back plate is configured and arranged to be received in the passage of the sliding adjustment member and to engage the first post to selectively bind a strap also passing through the passage of the sliding adjustment member.

BRIEF DESCRIPTION OF THE DRAWINGS

The present invention can be more easily understood and further advantages and uses thereof will be more readily apparent, when considered in view of the detailed description and the following figures in which:

FIGS. 4B through 4E are illustrations of another embodiment of a slide engaging member;

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1B:
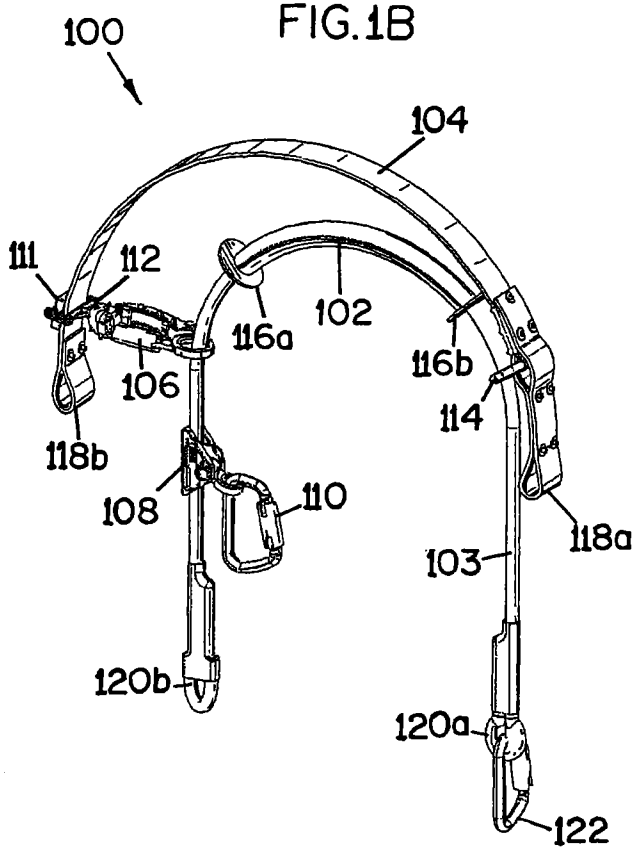
FIG. 1B is a second side perspective view of the fall prevention assembly of FIG. 1A.
Figure 1A:
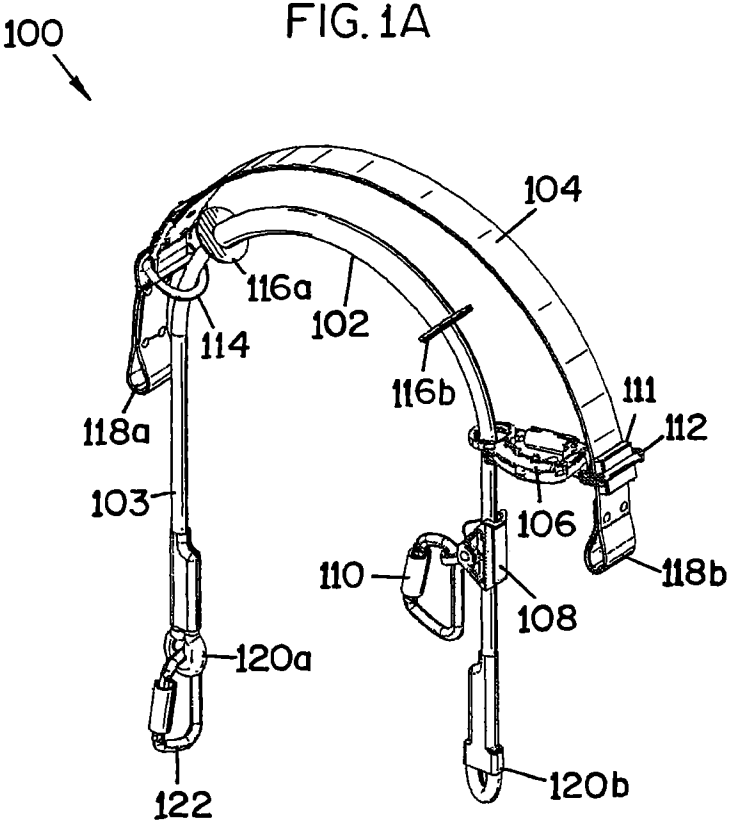
FIG. 1A is a first side perspective view of a fall prevention assembly of one embodiment of the present invention.
Figure 1C:
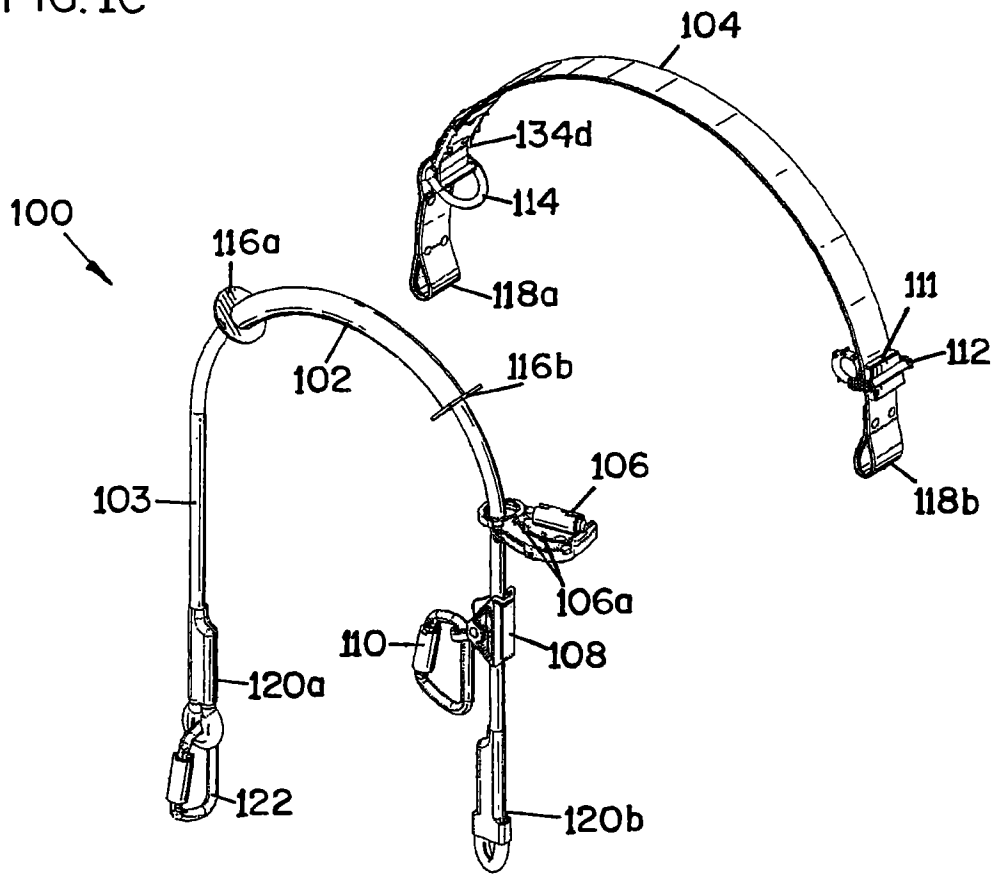
FIG. 1C is a first side perspective view of the fall prevention assembly of FIG. 1A with the pole strap disconnected from the lanyard.
Figure 10A:
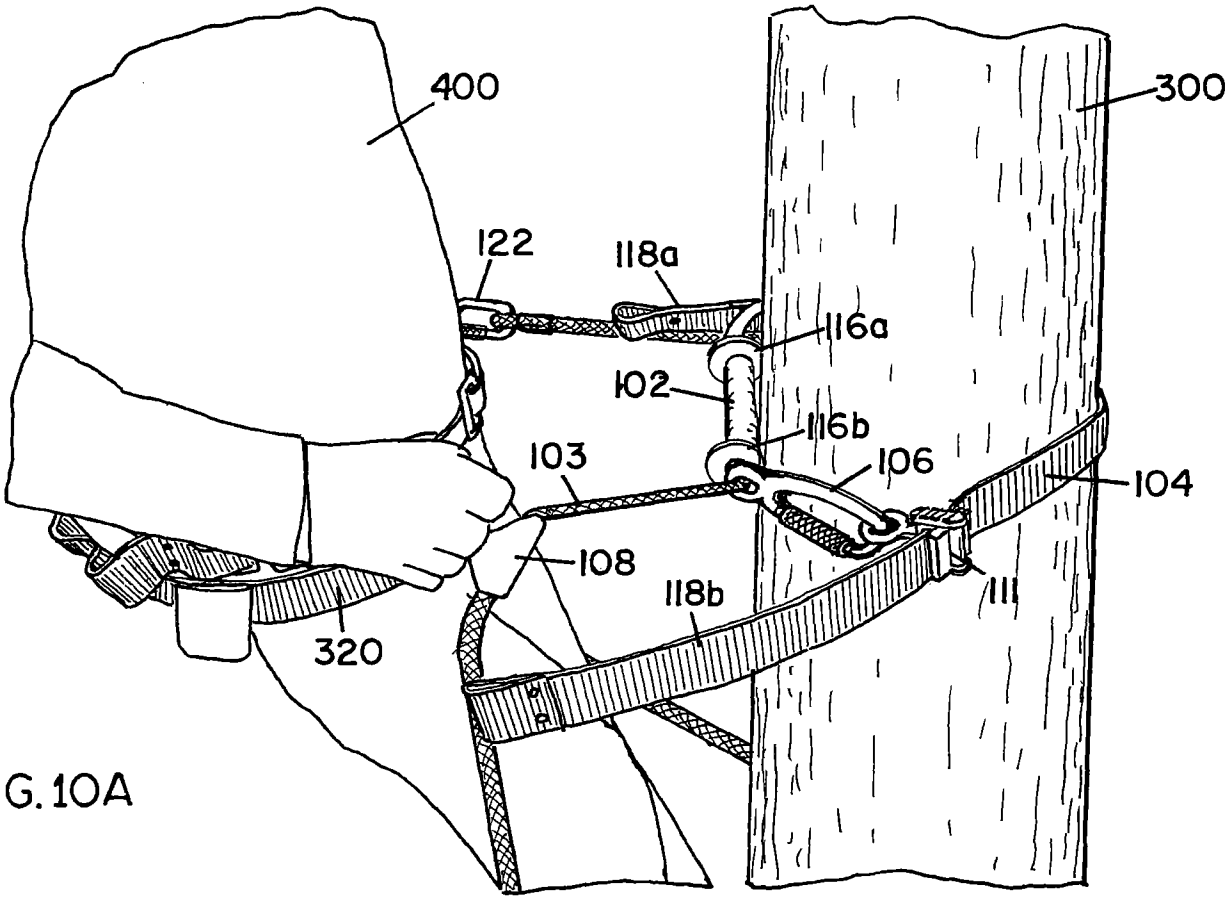
FIG. 10A is a side perspective view of the fall prevention assembly coupled to a pole.
Figure 10B:
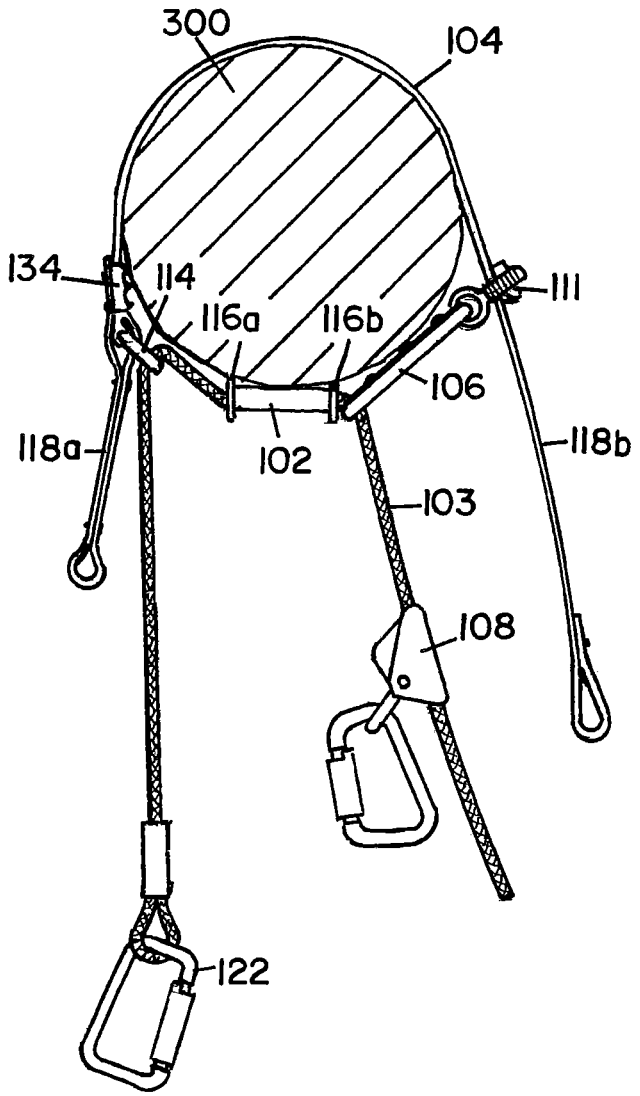
FIG. 10B is a top view of the fall prevention assembly coupled to the pole.

Embodiments of the present invention provide a pole climbing fall prevention assembly 100 that is easy to use as well as an effective fall protection device. Referring to FIGS. 1A through 1C, a fall prevention assembly 100 of one embodiment is illustrated. The fall prevention assembly 100 includes a pole strap 104 and a lanyard 103. The pole strap 104 in one embodiment is made of neoprene impregnated nylon webbing and in one embodiment the lanyard 103 is made of nylon rope. In use, the pole strap 104 and the lanyard 103 are positioned around a pole to be climbed. This is generally illustrated in FIGS. 10A and 10B. The lanyard 103 is then coupled to a safety harness of a user which is illustrated generally in FIGS. 11 and 12. Referring back to FIGS. 1A though 1C, the lanyard 103 terminates in ends 120*a* and 120*b*. A first carabiner 122 selectively couples end 120*a* of the lanyard 103 to a user's safety harness. A rope grab 108 is selectively moveably coupled to the lanyard 103 proximate the other end 120*b* of the lanyard 103. The rope grab 108 allows the user to adjust the distance between the user's torso in relation to the pole to be climbed. The rope grab 108 is further described below. A second carabiner 110 is used to couple the rope grab 108 to the user's safety harness.

An engaging sleeve 102 is positioned around the lanyard 103 to engage the pole to be climbed. The engaging sleeve 102 in one embodiment is made from an abrasion resistant fabric such as, but not limited to, a fabric that includes ceramic material. An example of a suitable material from which the engaging sleeve 102 could be made is "Super Fabric" manufactured by HDM Inc. of Oakdale, Minn. Coupled to the ends of the engaging sleeve are adjustment rings 116*a* and 116*b* that allow the user to adjust the length of the engaging sleeve 102 to engage the pole while not interfering with the cinching of the fall prevention assembly 100 when in use. The length is adjusted by sliding the adjustment rings 116*a* and 116*b* inward to gather the engaging sleeve 102 by positioning the ends closer together or, if already at least partially gathered, by sliding the adjustment rings 116*a* and 116*b* outward away from one another.

Figure 2B:
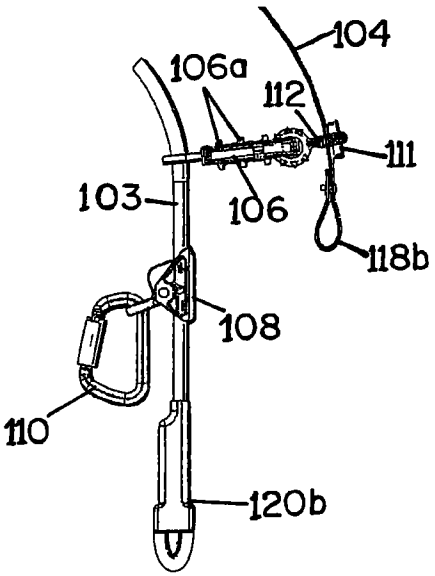
FIG. 2B is a close up view of a portion of the fall prevention assembly of FIG. 2B.
Figure 2A:
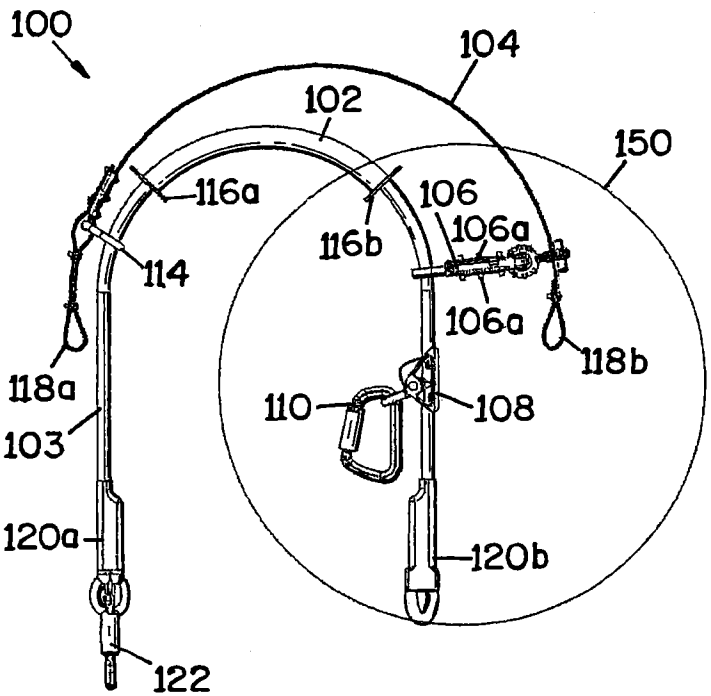
FIG. 2A is a first side view of the fall prevention assembly of FIG. 1A.

The pole strap 104 terminates in ends 118*a* and 118*b*. The pole strap 104 is coupled to the lanyard by a D-ring 114 and a sliding engaging member 112 that is selectively slidably coupled to the pole strap 104. The D-ring is coupled a distance from a distal end of the first end 118*a* of the pole strap. The sliding engaging member 112 includes a snap hook 106 that is coupled to the lanyard 103 at one end and is selectively coupled to the sliding engaging member 112. The snap hook 106, in this embodiment, includes protrusions 106*a* (teeth) that extend outward from a body of the snap hook 106. The teeth 106*a* are designed to engage the pole when the fall prevention assembly 100 is in use. The sliding engaging member 112 fits around the pole strap 104 and along with a floating back plate 111 selectively slidably engages the pole strap 104 as further discussed below. FIG. 2A illustrates a side view of the fall prevention assembly 100 and FIG. 2B illustrates a section 150 of the fall prevention assembly 100 that includes the snap hook 106 and the sliding engaging member 112.

Figure 3A:
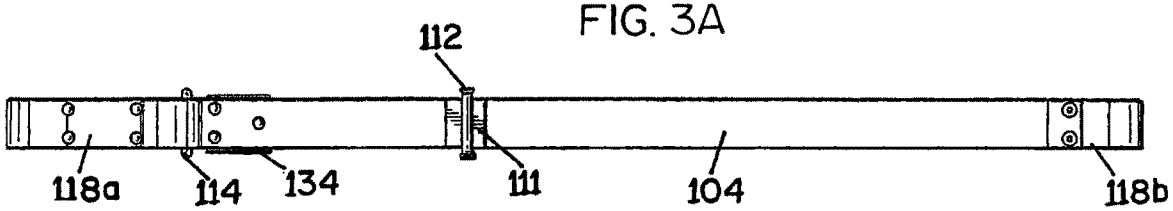
FIG. 3A is a top view of a pole strap of one embodiment of the present invention.
Figure 3B:
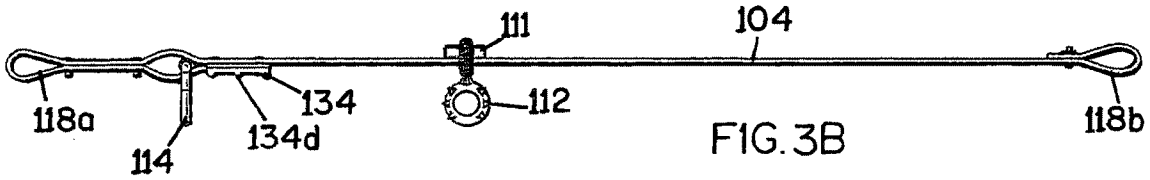
FIG. 3B is a side view of the pole strap of FIG. 3A.
Figure 3C:
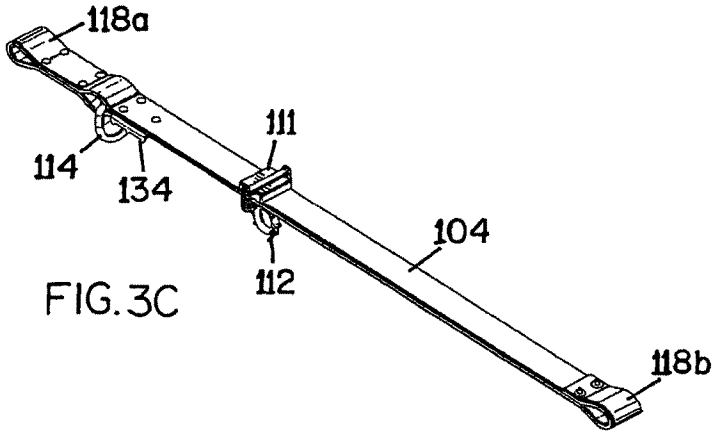
FIG. 3C is a side perspective view of the pole strap of FIG. 3A.
Figure 3D:
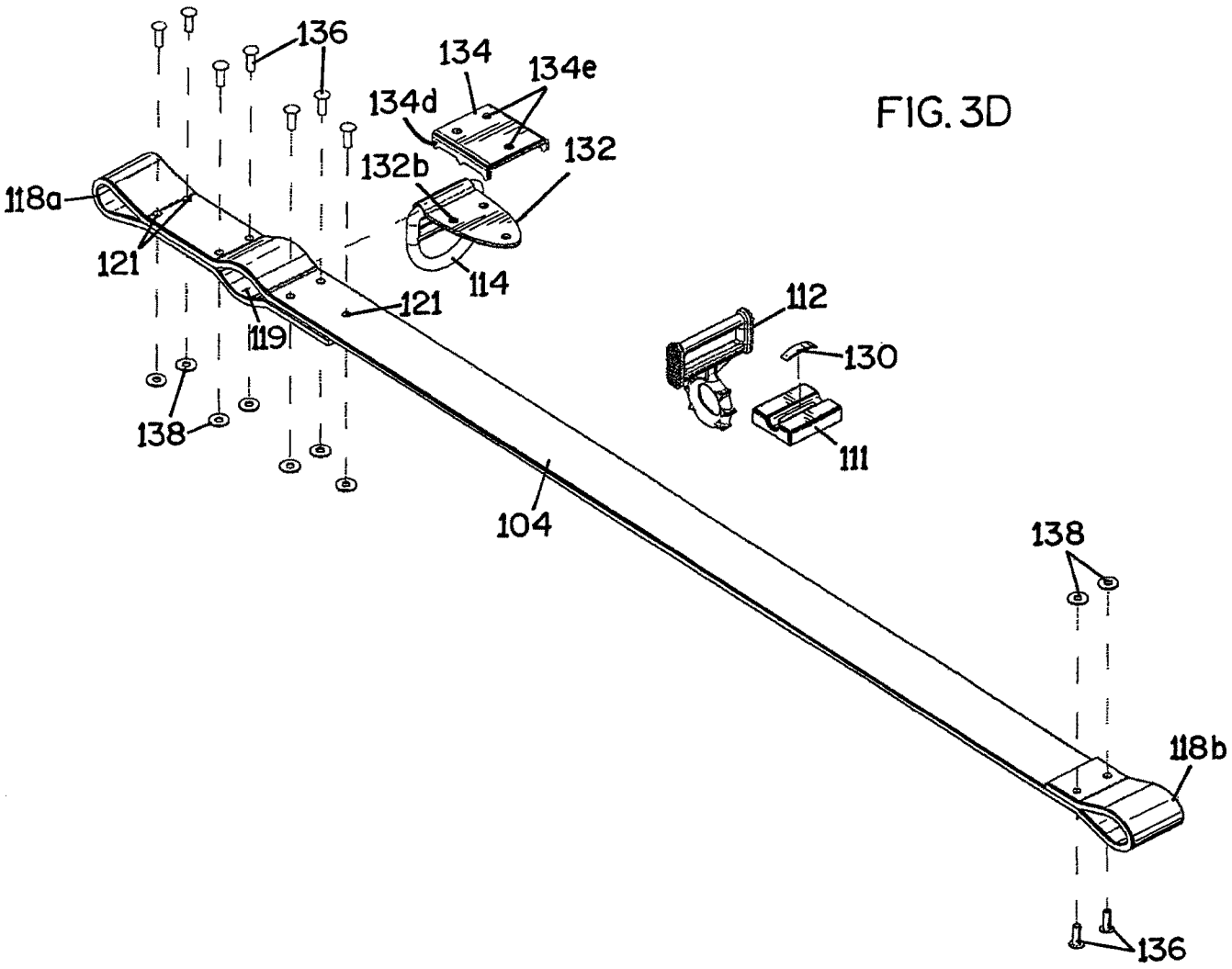
FIG. 3D is a side perspective exploded view of the pole strap of FIG. 3A.

FIGS. 3A through 3C illustrate various views of the pole strap 104. In particular, FIGS. 3A through 3D illustrate the D-ring 114, an engaging plate 134 (stopping cleat), the sliding engaging member 112 and floating back plate 111. FIG. 3D further illustrates how the pole strap 104 is configured in one embodiment. As illustrated, end portion 118*a* of the strap 104 is folded back on itself to form channel 119 that is a select distance from a distal end of the end portion 118*a* of the pole strap 104. A portion of the D-ring 114 is positioned in channel 119 to couple the D-ring to the pole strap 104. A plurality of fastening apertures 121 are formed through the overlapped end portions of the strap 104. Fasteners 136 and 138 are positioned in the apertures 121. In one embodiment, the fasteners are rivets 136 and washers 138. A clip 132 having clip apertures 132*b* is coupled around a portion of the D-ring 114 and is coupled to the strap 104 via fasteners extending through apertures 132*b* and 121. Also coupled around a portion of the strap 104 is engaging plate 134. The engaging plate 134 has teeth 134*d*, described further below, that engage the pole being climbed. The engaging plate 134 further has engaging apertures 134*e* that align with the clip apertures 132*b* of the clip 132 and the fastening apertures 121 of the strap 104 and are also coupled to the strap 104 via the fasteners 136 and 138. In one embodiment, a portion of the clip 132 and a portion of the engaging plate 134 are sandwiched between the folded back portion of the pole strap 104 as discussed further below. Further illustrated in FIG. 3D is the sliding engaging member 112, the floating back plate 111 and a biasing back plate member 130 that fits in a holding recess portion of the back plate 111.

Figure 4A:
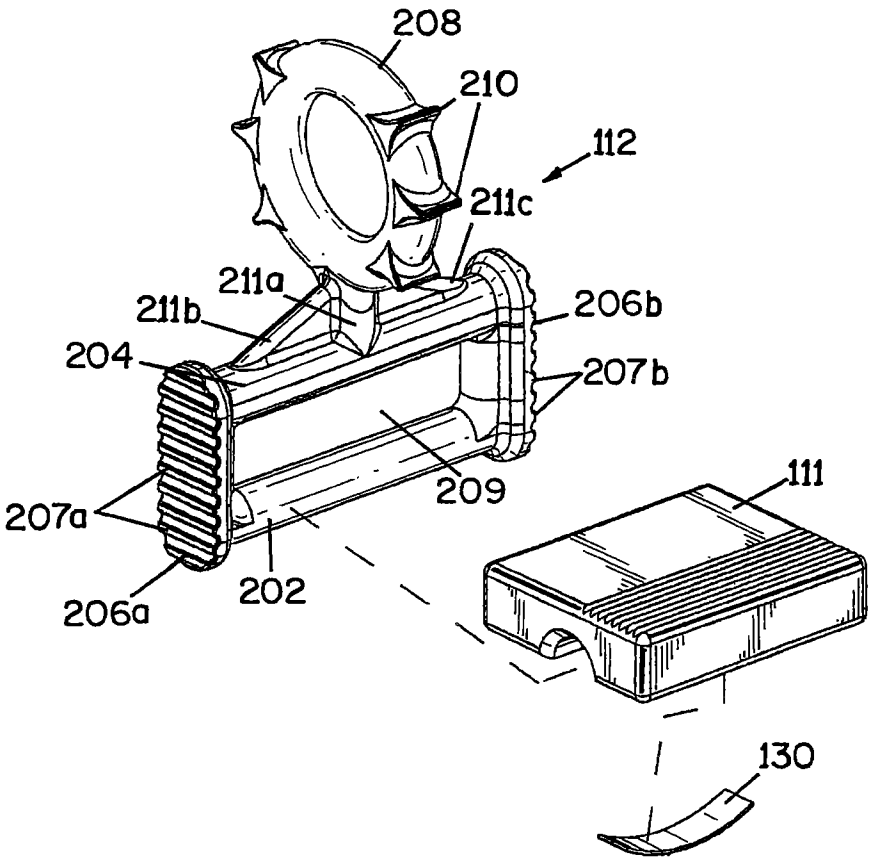
FIG. 4A is a side perspective view of a slide engaging member of one embodiment of the present invention.
Figure 4F:
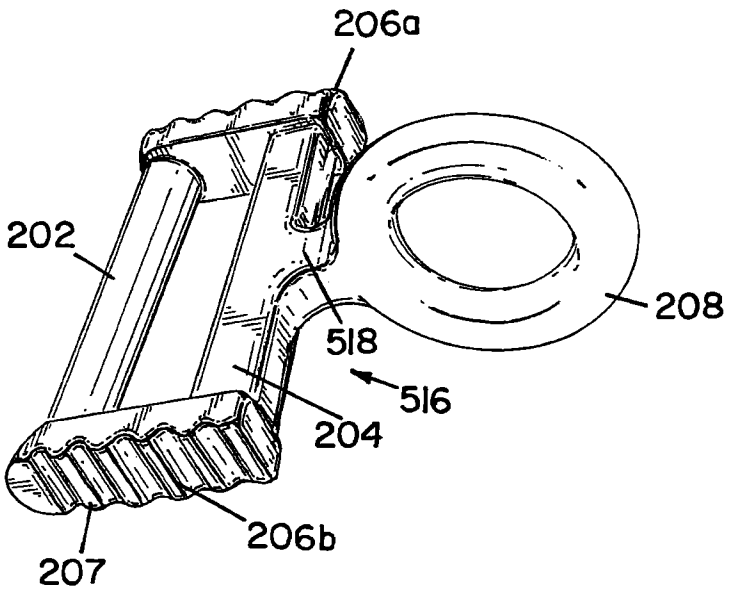
FIG. 4F is an illustration of yet another embodiment of a slide engaging member.

The sliding engaging member 112 and floating back plate 111 are further illustrated in FIG. 4A. The sliding engaging member 112 includes a first post 202 and a second post 204. The first post 202 and the second post 204 are coupled between side plates 206*a* and 206*b* at a spaced distance. The spacing between the first post 202, the second post 204, the first side plate 206*a* and the second side plate 206*b* form passage 209 through which the pole strap 104 passes and the back plate 111 is held. Each of the side plates 206*a* and 206*b* in this embodiment has an outer surface that includes grooves 207*a* and 207*b*, respectively. The grooves 207*a* and 207*b* in the outer surface of side plates 206*a* and 206*b* create surfaces with a gripping configuration that allows for easy manipulation of the sliding engaging member 112 about the strap 104 with a user's fingers. A toroidal shaped (donut shaped) connecting head 208 is coupled to the second post 204 via supports 211*a*, 211*b* and 211*c*. The connecting head 208, in this embodiment, includes a plurality of teeth 210 that are designed to grip a pole upon which the user is climbing. FIGS. 4B through 4E illustrate another embodiment of a sliding engaging member 512. In this embodiment, the head 208 does not include teeth, such as teeth 210 in the embodiment of FIG. 4A. Further, FIG. 4F illustrates another embodiment of a sliding engaging member 516 (or O-ring adjuster 516). In this embodiment, a single post 518 couples the connecting head 208 to the first post 202.

Figure 5B:
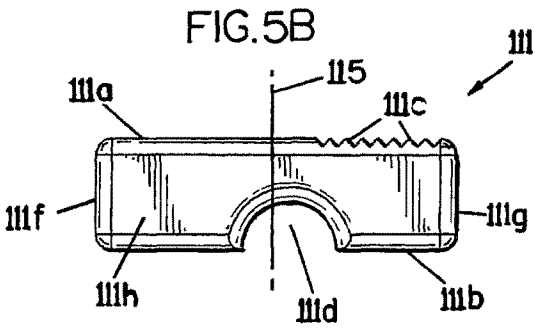
FIG. 5B is a side view of the floating back plate of FIG. 5A.
Figure 5D:
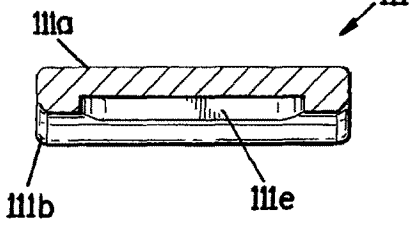
FIG. 5D is a cross-sectional side view of the floating back plate of FIG. 5A.
Figure 5A:
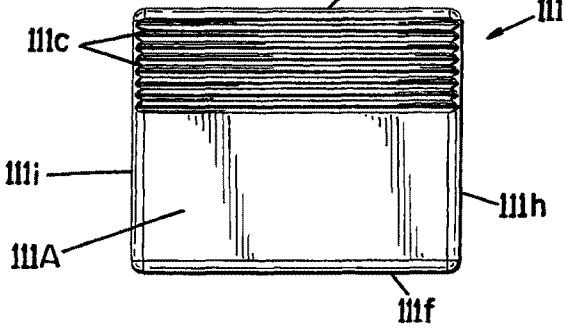
FIG. 5A is a top view of a floating back plate of one embodiment of the present invention.
Figure 5C:
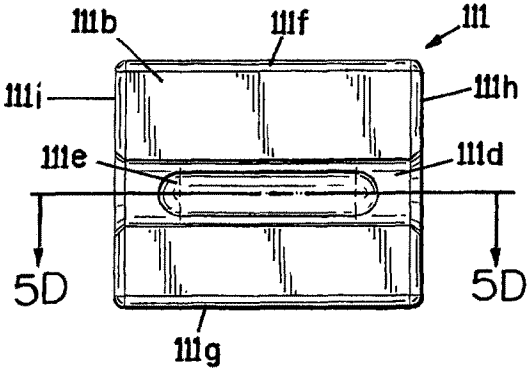
FIG. 5C is a bottom view of the floating back plate of FIG. 5A.
Figure 5H:
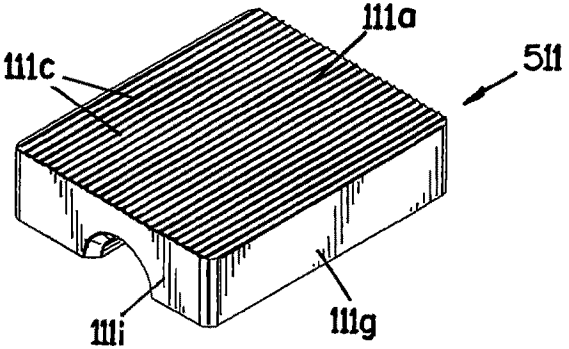
FIGS. 5E through 5H are perspective illustrations of another embodiment of the floating back plate of the present invention.
Figure 5E:
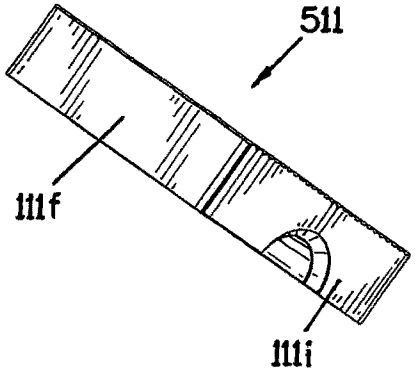
Figure 5F:
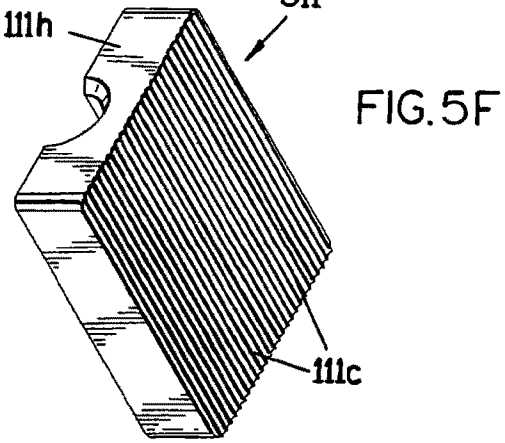
Figure 5G:
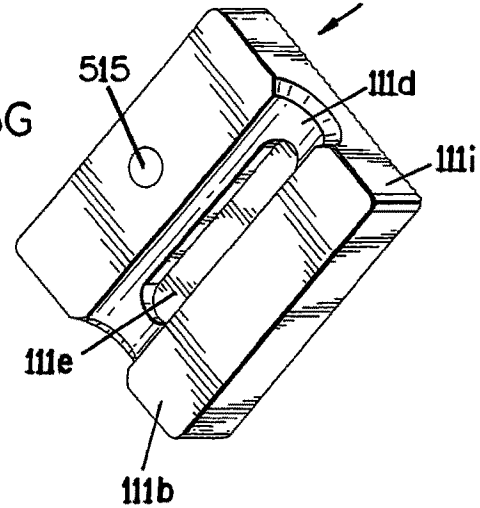

The floating back plate 111 is further described in regards to FIGS. 5A through 5D. The floating back plate 111 has a first side 111*a* and a second side 111*b* opposite the first side 111*a*. The floating back plate 111 further has a first edge 111*f*, a second edge 111*g* opposite the first edge 111*f*, a third edge 111*h* and a fourth edge 111*i* opposite the third edge 111*h*. A portion of the first side 111*a* has a plurality of formed elongated teeth 111*c* that form a seriated surface that extends from the third edge 111*h* to the fourth edge 111*i* proximate second edge 111*g* as illustrated in FIGS. 5, 5A and 5B. The elongated teeth 111*c* are designed to engage the strap 104 to increase the friction between the strap 104 and the floating back plate 111. As FIG. 5B illustrates, the second side 111*b* of the floating back plate 111 includes a semi-circular retaining groove 111*d* that is designed to engage the first post 202 of the sliding engaging member 112. The retaining groove 111*d* also extends from the third edge 111*h* to the fourth edge 111*i*. In one embodiment, the retaining groove 111*d* is offset from a mid-point 115 between the first edge 111*f* and the second edge 111*g* to achieve a desired moment of inertia with the floating back plate 111 while cinching the fall prevention assembly 100 to a pole being climbed. The groove 111*d* further includes a holding recess portion 111*e* as illustrated in FIG. 5C and the cross sectional side view along line A-A in FIG. 5D. The holding recess portion 111*e* is designed to hold the biasing back plate member 130. The biasing back plate member 130 asserts a biasing force that urges the first side 111*a* of the floating back plate 111 into the strap 104. FIGS. 5E through 5H illustrate another embodiment of a floating back plate 511. In this embodiment, the teeth 111*c* (or seriated surface) extend across the entire first side 111*a* of the floating back plate 511. Also illustrated in this embodiment, is a small indication aperture 515 used to indicate a portion of the second side 111*b* of the floating back plate 511 that is larger than another portion separated by retaining groove 111*d*. The identification is used in positioning the back plate 511 in the passage in the sliding engaging member 112.

Figure 6A:
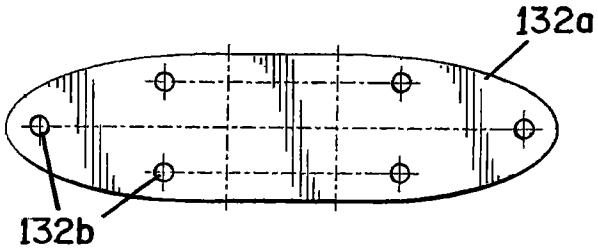
FIG. 6A is a top view of an unformed clip of one embodiment of the present invention.
Figure 6B:
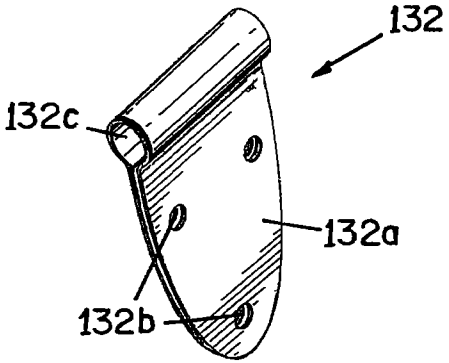
FIG. 6B is a side perspective view of a formed clip of one embodiment of the present invention.
Figure 7B:
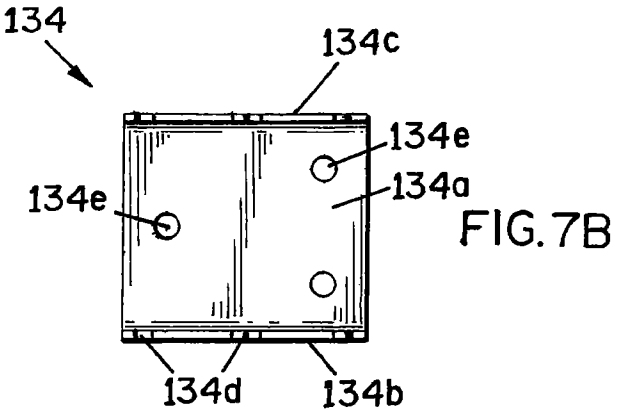
FIG. 7B is a bottom view of the engaging plate of FIG. 7A.
Figure 7C:
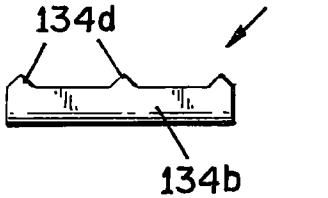
FIG. 7C is a side view of the engaging plate of FIG. 7A.
Figure 7A:
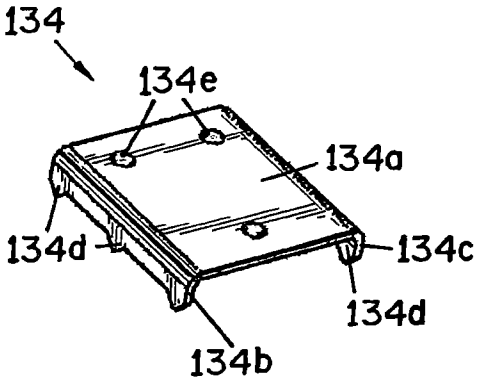
FIG. 7A is a side perspective view of an engaging plate of one embodiment of the present invention.

An example of the clip is illustrated in FIGS. 6A and 6B. In particular, FIG. 6A illustrates the shape of the material 132*a* that is used to form clip 123. Clip 132 is made from a plate of resilient material such as, but not limited to, a metal. The clip apertures 132*b* are formed in the material 132*a*. The material 132 is then bent to form the clip 132 as illustrated in FIG. 6B. The clip 132, as formed, includes a clip passage 132*c* in which a portion of D-ring 114 is received as illustrated in FIG. 3D. In one embodiment, the clip 123 is positioned between the folded back portions of the pole strap 104 proximate the end portion 118*a* of the pole strap 104 such that the clip passage 132*c* is received in passage 119 of the strap 104. The engaging plate 134 (stopping cleat) is further illustrated in FIGS. 7A through 7C. As illustrated, the engaging plate 134 includes a mid-portion 134*a*. Engaging apertures 134*e* pass through the mid-portion 134*a* of the engaging plate 134. Opposed first and second sidewalls 134*a* and 134*c* extend in generally a perpendicular direction from opposite edges of the mid portion 134*a*. Hence, the engaging plate is generally formed in a U-shape. Each of the sidewalls 134*a* and 134*c* terminate in teeth 134*d*. In an embodiment, the mid portion 134*a* of the engagement plate 134 is also positioned between the folded back portion of the strap 104 adjacent a portion of the clip 123. The engaging apertures 134*c* of the engagement plate 134, the clip apertures 132*b* of the clip 132 and select fastening apertures 121 of the strap 104 are aligned so the fasteners 136 and 138 can couple the engagement plate 134, the clip 132 to the strap 104. As illustrated in at least FIGS. 1C and 3B, the teeth 134*d* that terminate the sidewalls 134*a* and 134*c* extend out beyond a width of the strap 104 to engage a pole upon which the user is climbing.

Figure 8C:
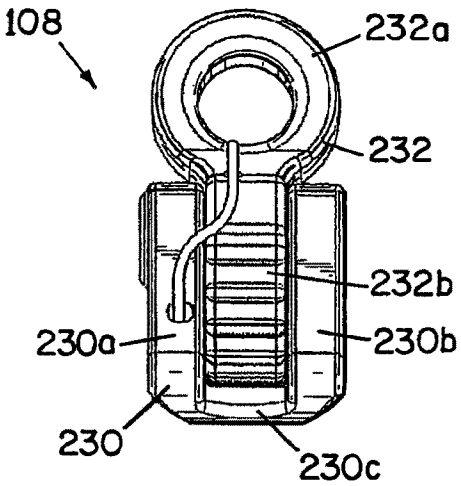
FIG. 8C is an end view of the rope grab of FIG. 8A.
Figure 8A:
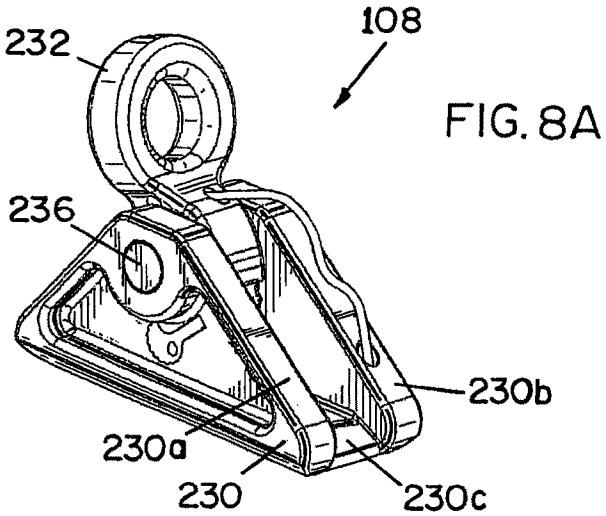
FIG. 8A is a side perspective view of a rope grab of one embodiment of the present invention.
Figure 8B:
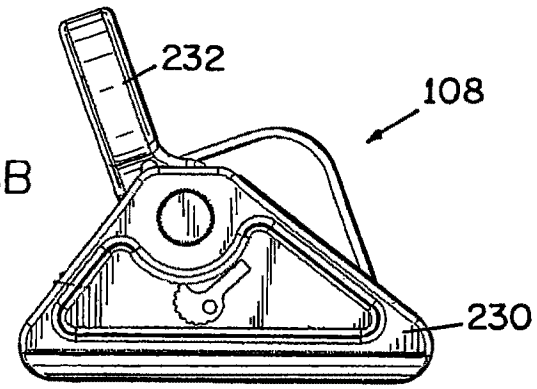
FIG. 8B is a side view of the rope grab of FIG. 8A.

FIGS. 8A through 8C illustrate an embodiment of a rope grab 108. Although any suitable rope grab could be used, an example of a suitable rope grab is one manufactured by Rock Exotica of Clearfield, Utah. This rope grab 108 includes a base 230*c* and opposed sidewalls 230*a* and 230*b* that extend from opposite edges of the base 230*c* in generally a perpendicular fashion such that the base 230*c* and sidewalls 230*a* and 230*b* form generally a U-shape. The rope grab 108 further includes an activation assembly 232. The activation assembly 232 includes a connector portion 232*a* designed to be coupled to a connector, such as a D-ring and the like, and rope engaging portion 232*b*. The rope engaging portion 232*b* is rotationally coupled between the opposed sidewalls 230*a* and 230*b* via connecting rod 236. A rope passage 231 is formed between the opposed sidewalls 230*a* and 230*b*, the base 230*c* and the rope engaging portion 232*b* of the activation assembly 232. The lanyard 103 passes through the rope passage 231. The rope engaging portion 232*b* of the activation assembly 232 is notched to provide a gripping surface to engage the lanyard 103 when the activation assembly 232 is rotated to engage the lanyard 103.

Figure 9A:
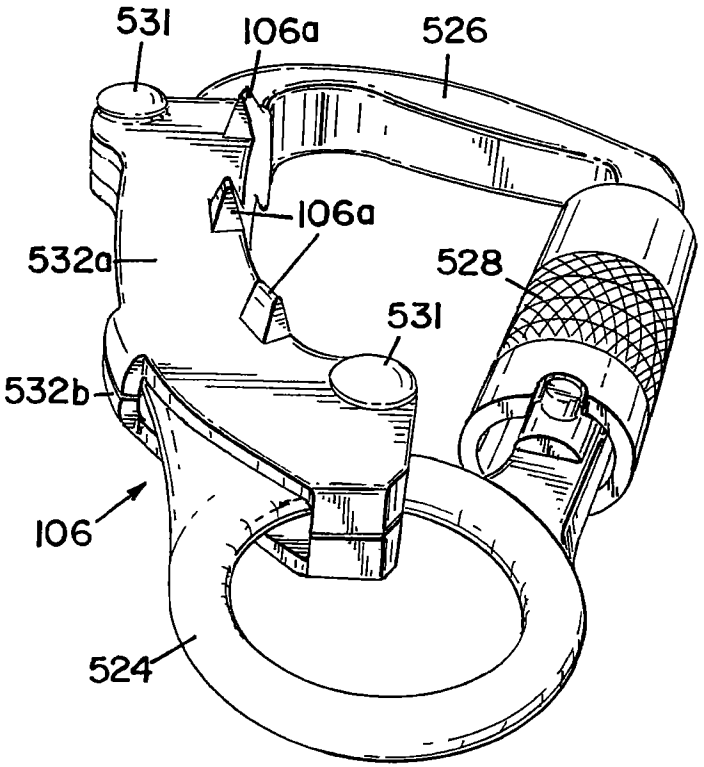
FIG. 9A is an illustration of a first embodiment of a spiked carabiner of the present invention.
Figure 9B:
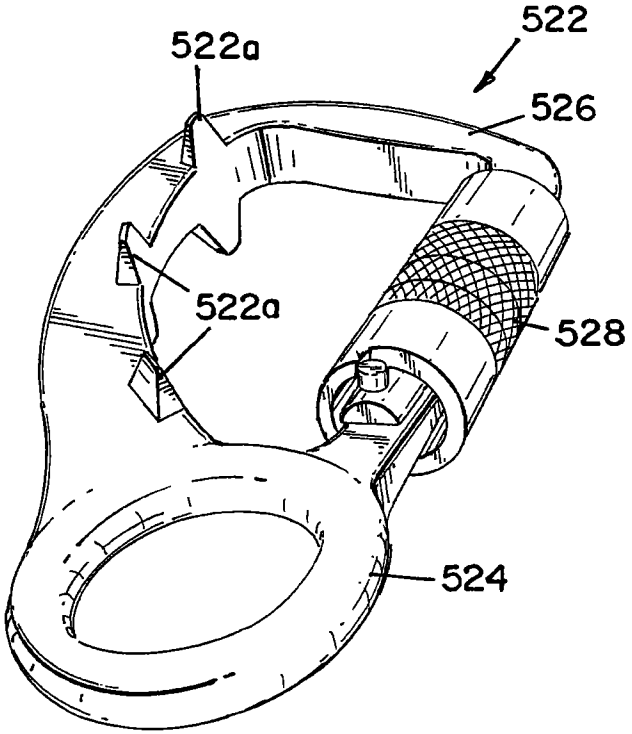
FIG. 9B is an illustration of a second embodiment of a spiked carabiner of the present invention.

FIG. 9A illustrates a first embodiment of a carabiner 106. This embodiment includes a first portion 524 (o-ring) coupled to a second portion 526 (which is generally c-shaped) and a gate 528. In one embodiment a captive eye carabiner assembly is used. The gate 528 is designed to selectively be opened and closed to selectively couple the second portion 526 to the coupling portion 208 of the sliding adjustment member 212. Also included in this embodiment is a spike assembly (or stopping cleat assembly) that includes a first plate 532*a* that includes spikes 106*a* and a second plate 532*b*. The plates 532*a* and 532*b* are coupled about a portion of the second portion of the carabiner 106 via fasteners 531. The spikes 106*a* engage the pole when in use. FIG. 9B illustrates another embodiment of the carabiner 522, in this embodiment, spikes 522*a* (or teeth) are formed via a forging process with the second portion 526 of the carabiner 522 so that a spike assembly as described above is not needed. In another embodiment the spikes 522*a* are formed by a casting process.

Figure 12:
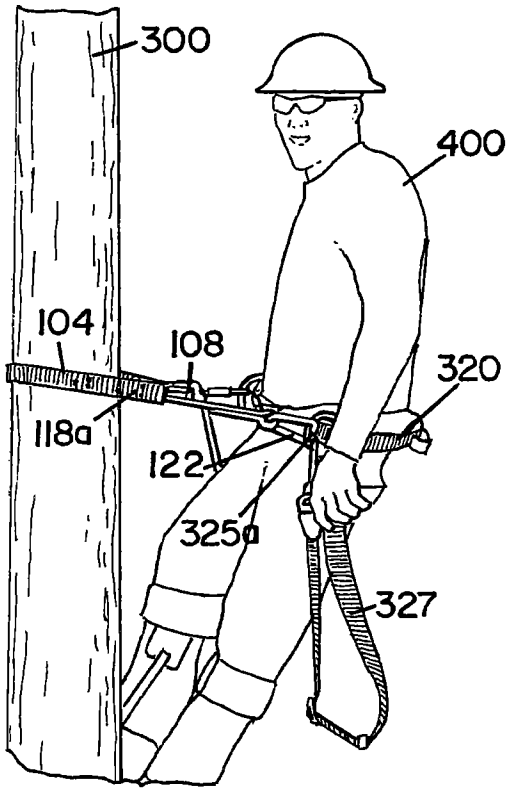
FIG. 12 is a second side perspective view of the fall prevention assembly in use.
Figure 11:
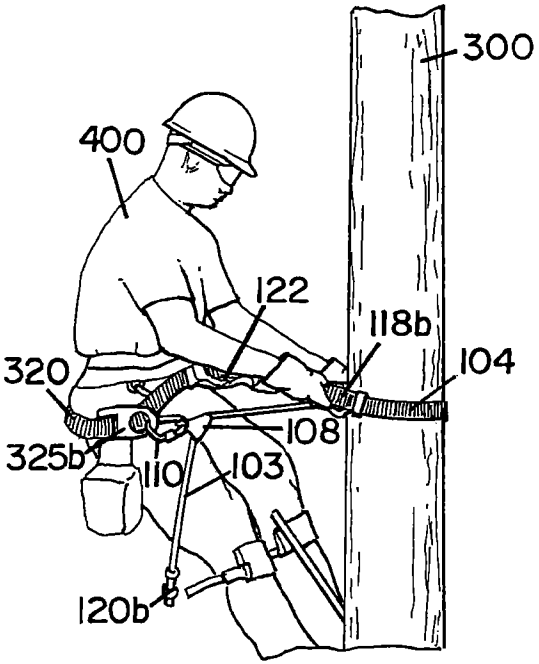
FIG. 11 is a first side perspective view of the fall prevention assembly in use.
Figure 13:
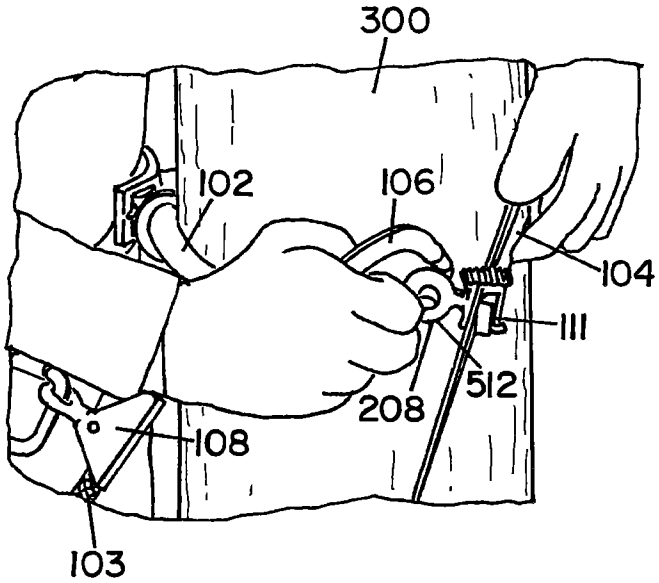
FIG. 13 is an illustration of how to attach the fall prevention assembly to a pole.

FIG. 10A illustrates a side perspective view of the fall prevention assembly 100 positioned around a pole 300 and FIG. 10B illustrates a top view of the fall prevention assembly 100 positioned around the pole 300. FIGS. 11 through 13 further illustrate a user 400 implementing the fall prevention assembly 100 to climb a pole 300. In use, the user (climber) 400 typically attaches carabiners 122 and 110 attached on the respective ends of the lanyard 103 to respective D-rings 325*a* and 325*b* on the user's safety harness 320. The user 400 then reaches around the pole 300 to be climbed with the pole strap 104 and engages the snap hook 106 attached to the lanyard 103 to the sliding engagement member 112 as illustrated in FIG. 13. This places the pole 300 between the pole strap 104 and the lanyard 103 as illustrated in FIGS. 10A and 10B. Adjusting the pole strap 104 and the lanyard 103 about the pole 300 is accomplished by the user 400 grasping the outer surface of the side plates 206*a* and 206*b* of the sliding adjustment member 112 with one hand and sliding the pole strap 104 through passage 209 of the sliding adjustment member 112 in a select direction to tighten or loosen the pole strap 104 and the lanyard 103 about the pole 300 as desired with the user's other hand. In adjusting the pole strap 104 and lanyard 103 about the pole 300, the teeth 134*a* of the stopping cleat 134 should be engaged with the pole 300 about a select location in relation to the user 400. In particular, the stopping cleat 134 should be positioned around an outer surface of the pole 300 within a nine o'clock to a three o'clock position in relation to the position of the user 400 to ensure the stopping cleat 134 properly engages the pole 300 during a fall event. Moreover, if the pole 300 circumference decreases as the user 400 climbs, the positioning of the pole strap 104 and the lanyard 103 may have to be adjusted to keep the stopping cleat 134 in the desired location on the pole. The distance between the user 400 and the pole 300 is adjusted by manipulating the rope grab 108 that is adjustably coupled to the lanyard 103. In one embodiment, a knot 322 is created near the second end 120*b* of the lanyard 103 to prevent the lanyard 103 from passing all the way through the rope grab 108.

Once the pole strap 104 and the lanyard 103 are positioned around the pole 300 and the fall prevention assembly 100 is adjusted, the user 400 is ready to climb the pole 300. The user 400 moves the fall prevention assembly 100 in relation to the pole 300 via grasping the ends 118*a* and 118*b* of the pole strap 104 and sliding the fall prevention assembly 100 in relation to the pole 300. In particular, the user 400 grasps the first end 118*a* of the pole strap 104 with a first hand that is positioned between a distal end of the first end 118*a* and the D-ring 114 and the second end 118*b* of the pole strap 104 with a second hand positioned between a distal end of the second end 118*b* and the sliding adjustment member 112 when moving the fall prevention assembly 100 in relation to the pole 300. Having the second hand positioned proximate the sliding adjustment member 112 allows for the easy and fast adjustment of the pole strap 104 and lanyard 103 around the pole 300 as the user 400 is climbing or descending the pole 300. In particular, the tightness of the fall prevention assembly 100 around the pole 300 can be adjusted with only one hand of the user 400 when no tension is being applied to the fall prevention assembly 100. When the user 400 is ready to reposition the fall prevention assembly 100 on the pole, the pole strap 104 slides relatively easily within passage 209 of the engagement slide engaging member 112 to adjust the tightness of the fall prevention assembly 100 about the pole.

In particular, to climb, the user 400 first loosens the fall prevention assembly 100 around the pole 300 by manipulating the sliding engaging member 112. Once loose, the user 400 grasps the ends 118*a* and 118*b* of the strap 104 and moves the fall prevention assembly 100 up the pole 300. The fall prevention assembly 100 is then tightened about the pole 300 via manipulation of the sliding engaging member 112. The user 400 then moves up the pole 300 a select distance until the fall prevention assembly 100 has to be repositioned. This process is repeated until the user 400 reaches a desired location on the pole 300. In descending, the user 400 manipulates the sliding engaging member 112 to loosen the fall prevention assembly 100. The user 400 then positions the fall prevention assembly 100 lower on the pole 300 via grasping the ends 118*a* and 118*b* of the strap 104. The user 400 then tightens the fall prevention assembly 100 on the pole by manipulating the sliding engaging member 112. The user 400 then climbs down the pole 300 a select distance until the fall prevention assembly 100 has to be repositioned. This process continues until the user 400 reaches the ground.

When the user 400 encounters an obstacle, the fall prevention assembly 100 has to be disconnected. A secondary strap 327 is attached around the pole 300 while the fall prevention assembly 100 is detached from the pole 300. In particular, once a user 400 reaches an obstacle, the user 400, secures the secondary strap 327 (that is coupled to the user's 400 safety harness 320) around the pole 300. Once, the secondary strap 327 is secured around the pole, the fall prevention assembly 100 is disconnected from the pole 300 by disconnecting the snap hook 106 from the sliding adjustment member 112. The pole strap 104 and the lanyard 103 are then repositioned over the obstacle (if the user 400 is climbing up) or under the obstacle (if the user is climbing down) and then reattached by engaging the snap hook 106 to the sliding adjustment member 112. The secondary strap 327 can then be disconnected from the pole 300. As illustrated in FIG. 12, the secondary strap 327 is stored on D-ring 325*a* of the safety harness 320 when not in use.

When tension is being applied to the fall prevention assembly 100, the back plate 111 of the slide engaging member 112 causes the slide engaging member 112 to lock onto the belt 104 by wedging the belt 104 into the second post 204 of the slide engagement member 112. In a fall event, tension on the lanyard 103 of the fall prevention assembly 100 as a result of the fall causes the floating back plate 111 and sliding adjustment member 112 to assert a pressure on the pole strap 104 to cinch the fall prevention assembly 100 on the pole 300. Teeth 134*d* of the stopping cleat 134, teeth 210 of the slide engaging member 112 and protrusions 106*b* of the snap hook 106 dig into the pole 300 also during a fall event to maintain the fall prevention assembly in a static location in relation to the pole 300. Hence, if a user falls, the fall prevention assembly 100 prevents the user from falling to the ground via the cinching action of the fall prevention assembly 100 on the pole 300 and the engagement of the teeth 134*d*, 210 and protrusions 106*b* with the pole 300.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A fall prevention assembly comprising:

a pole strap having a first end, a second end and a mid-portion between the first end and the second end, the second end of the pole strap being folded back on itself and secured to form a channel a select distance from a second distal end of the second end;

a first connector having a first end coupled proximate a first distal end of the first end of the pole strap, the first end of the pole strap extending outward from the first connector to form a first grasping end;

a second connector coupled within the channel of the second end of the pole strap, the second end of the pole strap extending outward from the second connector to form a second grasping end;

a lanyard having a first end, a second end and mid-portion between the first and second ends, a second end of the first connector slidably coupled to the lanyard, a second end of the second connector slidably coupled to the lanyard such that the mid-portion of the pole strap and the mid-portion of the lanyard can be positioned around a pole to be climbed;

a first carabiner operatively connected to the first end of the lanyard and configured and arranged to interconnect the lanyard and a safety harness;

a second carabiner operatively connected to the lanyard proximate the second end of the lanyard and configured and arranged to interconnect the lanyard and the safety harness; and an engaging sleeve received around the mid-portion of the lanyard to cover at least a portion of the mid-portion of the lanyard, wherein the engaging sleeve terminates in adjustment rings configured for adjusting the length of the engaging sleeve.

2. The fall prevention assembly of claim 1, wherein the engaging sleeve is configured of fabric.

3. The fall prevention assembly of claim 2, wherein the fabric includes ceramic material.

4. The fall prevention assembly of claim 1, further comprising:

a floating back plate engaged between a portion of the first connector and the pole strap, the floating back plate configured and arranged to selectively bind the pole strap to the first connector.

5. The fall prevention assembly of claim 4, wherein the first connector includes a sliding engaging member, the sliding engaging member comprising:

a first post;

a second post;

a first side plate; and a second side plate, the first post and the second post extending between the first plate and the second plate in a spaced fashion such that a passage is formed by the first post, the second post, the first side plate and the second side plate, the pole strap passing through the passage, a portion of the floating back plate also received in the passage.

6. The fall prevention assembly of claim 5, wherein the sliding engaging member further comprises:

a connecting head extending from the second post, the connecting head having generally a toroidal shape, the connecting head configured and arranged to hold a snap hook coupled thereto.

7. The fall prevention assembly of claim 5, wherein each of the first side plate and the second side plate includes an outer surface with grooves configured and arranged to enhance movement of the sliding engaging member about the pole strap by the user.

8. The fall prevention assembly of claim 5, wherein the floating back plate further comprises:

a first side and a second side opposite the first side, at least a portion of the first side having formed elongated teeth configured to increase friction between the floating back plate and the pole strap, the second side of the floating back plate having a retaining groove configured and arranged to receive a portion of the first post of the sliding engaging member to retain the floating back plate between the first post and the pole strap.

9. The fall prevention assembly of claim 8, wherein the floating back plate has a mid-point between a first edge and a second edge of the floating back plate, the retaining groove extending from a third edge to a fourth edge of the retaining groove in a location that is offset from the mid-point.

10. The fall prevention assembly of claim 8, further comprising:

a surface defining the retaining groove in the second side of the floating back plate having a holding recess portion; and a biasing member received in the holding recess portion, the biasing member configured and arranged to assert a force on the first post to push the floating back plate to engage the pole strap.

11. The fall prevention assembly of claim 1, wherein a rope grab interconnects the second carabiner and the lanyard, the rope grab configured and arranged to slide along the lanyard and selectively engage the lanyard should a fall occur.

12. The fall prevention assembly of claim 1, wherein the first and second distal ends are unattached during use.

13. A fall prevention assembly comprising:

a first elongated member having a first end, a second end and mid-portion between the first and second ends, the first elongated member configured to be positioned around an outside portion of a pole to be climbed in relation to a user of the fall prevention assembly, the second end being folded back on itself and secured to form a channel a select distance from a second distal end of the second end;

a second elongated member having a first end, a second end and a mid-portion between the first and second ends, the second elongated member configured to be positioned around an inside portion of the pole to be climbed in relation to the user of the fall prevention assembly, the second elongated member configured and arranged to be selectively coupled to a safety harness of the user;

a first connector having a first portion selectively slideably coupled to the first elongated member proximate a first distal end of the first end and a second portion slideably coupled to the second elongated member, the first end of the first elongated member extending outward from the first connector to form a first grasping end;

a second connector having a first portion coupled within the channel of the second end of the first elongated member and a second portion coupled to the second elongated member such that the first and second connectors couple the first and second elongated members around the pole, the second end of the first elongated member extending outward from the second connector to form a second grasping end; and an engaging sleeve received around the mid-portion of the second elongated member to cover at least a portion of the mid-portion of the second elongated member; wherein the engaging sleeve terminates in adjustment rings that allow the user to adjust the length of the engaging sleeve.

14. The fall prevention assembly of claim 13, further comprising:

a rope grab engaged with the second elongated member proximate the first end, the rope grab configured and arranged to be selectively coupled to the safety harness of the user;

the second end of the second elongated member configured and arranged to be selectively coupled to the safety harness of the user.

15. The fall prevention assembly of claim 13, wherein the first and second distal ends are unattached during use.

16. A fall prevention assembly comprising:

a first elongated member having a first end, a second end, and a mid-portion between the first and second ends, the second end of the first elongated member being folded back on itself to form a channel a select distance from a distal end of the second end, the first elongated member configured to be positioned around an outside portion of a pole to be climbed in relation to a user of the fall prevention assembly;

a second elongated member having a first end, a second end, and a mid-portion between the first and second ends, the second elongated member configured to be positioned around an inside portion of the pole to be climbed in relation to the user of the fall prevention assembly, the second end of the second elongated member configured and arranged to be selectively coupled to a safety harness of the user;

a first connector having a first portion selectively slidably coupled to the first elongated member, a second portion slidably coupled to the second elongated member, and a spiked carabiner having a first portion slideably coupled to the second elongated member and a second portion selectively coupled to the sliding engaging member, at least one spike extending from the second portion of the spiked carabiner;

a second connector having a first portion secured in the channel of the second end of the first elongated member and a second portion coupled to the second elongated member such that the first and second connectors couple the first and second elongated members around the pole; and a floating back plate engaged between a portion of the first connector and the first elongated member, the floating back plate configured and arranged to selectively bind the first elongated member to the first connector.

17. The fall prevention assembly of claim 16, wherein the first connector includes a sliding engaging member, the sliding engaging member comprising:

a first post;

a second post;

a first side plate; and a second side plate, the first post and the second post extending between the first plate and the second plate in a spaced fashion such that a passage is formed by the first post, the second post, the first side plate and the second side plate, the first elongated member passing through the passage, a portion of the floating back plate also received in the passage.

* * * * *